United States Patent [19]

Hvilsted et al.

[11] Patent Number: 4,899,643

[45] Date of Patent: Feb. 13, 1990

[54] HYDRAULIC CYLINDER COMPRISING AT LEAST ONE ELECTRIC POSITION INDICATOR

[76] Inventors: Niels Hvilsted, Sandlodsvej 4, DK-325- Gilleleje; Kaj Pedersen, Smedestraede 31, DK-4793 Bogo, both of Denmark

[21] Appl. No.: 66,474

[22] Filed: Jun. 26, 1987

[30] Foreign Application Priority Data

Oct. 29, 1985 [WO] PCT Int'l Appl. ..... PCT/DK85/00100

[51] Int. Cl.[4] ..... F01B 25/26; F01B 31/12

[52] U.S. Cl. ..... 92/5 R; 324/207; 324/208

[58] Field of Search ..... 92/5 R; 91/DIG. 4; 116/204, 267; 73/314; 340/693, 679, 686, 689; 324/207, 208; 310/68 R, DIG. 3

[56] References Cited

U.S. PATENT DOCUMENTS

| | | | |
|---|---|---|---|
| 3,453,937 | 7/1969 | Haberman | 92/5 |
| 4,456,883 | 6/1984 | Bullis et al. | 324/464 |

FOREIGN PATENT DOCUMENTS

| | | | |
|---|---|---|---|
| 146422 | 3/1977 | Denmark . | |
| 1426448 | 2/1969 | Fed. Rep. of Germany . | |
| 1955238 | 6/1970 | Fed. Rep. of Germany . | |
| 2059592 | 9/1971 | Fed. Rep. of Germany . | |
| 2305688 | 8/1973 | Fed. Rep. of Germany | 92/32 |
| 7331588 | 7/1977 | France | 91/1 |
| 7605320 | 10/1977 | France | 92/5 R |
| 0072772 | 4/1983 | Japan | 92/5 R |
| 359896 | 9/1973 | Sweden . | |
| 522133 | 6/1972 | Switzerland . | |
| 1280759 | 7/1972 | United Kingdom . | |

*Primary Examiner*—Robert E. Garrett
*Assistant Examiner*—Thomas Denion
*Attorney, Agent, or Firm*—Saidman, Sterne, Kessler & Goldstien

[57] ABSTRACT

A hydraulic cylinder (1) with a piston (5) made completely or partially of electrically conductive material comprises at least one opening (19, 20) for the mounting of an electric position indicator (21, 22). The openings (19, 20) are closed in a liquid and pressure-proof manner towards the interior of the cylinder (1) by means of circular plate-shaped bodies (17, 18) glued to the inner surface of the cylinder (1). As the plate-shaped bodies (17, 18) are made of a ceramic material, preferably steatite, they may allow passage of the magnetic field transmitted from the electric position indicators (21, 22). The openings (19, 20) are adapted in the end covers (2, 3) of the cylinder (1) for the determination of the end positions of the piston (5). Furthermore the cylinder may be provided with piston-braking means in the form of seal rings (12, 13). As the piston (5) penetrates the magnetic field, an altered signal indicating the position of the piston (5) will be transmitted from the electric position indicator, which is preferably an inductive sensor. Very narrow inductive sensors being used it is now possible to built these into even very small hydraulic cylinders, so that these inductive sensors can be built into hydraulic cylinders of all sizes without being influenced by the high pressure of the cylinders. The hydraulic cylinder (1) according to the invention may even be manufactured in a very inexpensive and simple manner, and by building in the inductive sensors a previously unknown exact and reliable determination of the positions of the piston may furthermore be obtained.

20 Claims, 2 Drawing Sheets

HYDRAULIC CYLINDER COMPRISING AT LEAST ONE ELECTRIC POSITION INDICATOR

TECHNICAL FIELD

The invention relates to a hydraulic cylinder with a piston made completely or partially of electrically conductive material, said cylinder comprising at least one through opening for the mounting of an electric position indicator.

BACKGROUND ART

Several types of hydraulic cylinders of this type are known which are provided with contact-free electric position indicators for a remote display of the end positions of the piston. In order to obtain the contact-free establishment of contact magnetically operated switches are often mounted on the outside of the cylinder, the piston then necessarily comprising permanently magnetic material in order to actuate the switches. The latter implies, however, that the cylinder is made of non-ferromagnetic material encumbered with the drawback that it cannot withstand particularly high operational pressures when the cylinder is to be manufactured at a reasonable price. Furthermore these switches are expensive and fails often in operation. The system is therefore only used for hydraulic cylinders operating at a substantially lower operational pressure than the usual 200–300 bar.

U.S. Pat. No. 3,453,937 discloses a hydraulic cylinder of this type, and whereby a bore is provided in the housing of the cylinder for the mounting of an inductive sensor. The bore is closed towards the interior of the cylinder by a remaining part of the wall of the cylinder. As a result the housing of the cylinder must be made of a non-magnetizable material, preferably aluminium, so that the inductive sensor is able to transmit a magnetic field through the remaining portion of the wall of the cylinder. The use of aluminium implies that the housing of the cylinder must be manufactured with great dimensions in order to withstand the usually high operational pressures of the hydraulic cylinder. This hydraulic cylinder is therefore very expensive to manufacture and furthermore it is impossible to measure through the required thickness of the remaining part of the wall of the cylinder by means of a small inductive sensor.

Inductive sensors to be built into pressure containers and capable of withstanding pressures up to about 600 bar are, however, known. These sensors are, however, very expensive compared to usual electric position indicators, and furthermore they are of such a size—of a diameter of between 12 and 16 mm—that they can only be mounted in very great hydraulic cylinders. Such an inductive sensor controls the state of the linings, pistons, and piston rings in combustion engines and is known from Danish printed accepted specification No. 146,422. This inductive sensor is mounted in a container with a bottom. It is, however, necessary that the bottom is of a thickness of between 5 and 7 mm, and such a thickness never allows a measuring by means of a small inductive sensor.

In the frequently used hydraulic cylinders of a diameter of about 25 to 125 mm it is possible to mount inductive sensors of a diameter of about 4 mm. These small inductive sensors can, however, only withstand an operational pressure of up to about 70 bar, which does not suffize because the use of the normal operational pressure of 200–300 bar necessitates that the sensor can withstand pressure limits of up to 600–800 bar. Consequently, it is a great drawback that previously it has been impossible to provide hydraulic cylinders, especially of diameters of between 25 and 125 mm, and comprising electric position indicators at a reasonable price, and which can withstand the normal operational pressures.

DESCRIPTION OF THE INVENTION

The object of the invention is to provide a hydraulic cylinder of the above type which can be provided with at least one electric position indicator in such a manner that the cylinder can withstand the operational pressures usual for hydraulic cylinders, and which furthermore can withstand particularly high limit values of the operational pressure.

The hydraulic cylinder according to the invention is characterised in that the openings are closed in a liquid- and pressure-proof manner towards the interior of the cylinder by means of a substantially plate-shaped body secured on the inner surface of the cylinder and allowing passage of a magnetic field. In this manner a hydraulic cylinder is obtained which allows mounting of electric position indicators therein for the determination of the piston positions, and which furthermore can withstand the usual operational pressures without the electric position indicators being influenced by the operational pressure of the cylinder, said indicators often being inductive sensors. The latter is rendered possible especially for hydraulic cylinders of diameters of between about 25 and 125 mm because the electric position indicators then must be small in order to be mountable in the housings or end covers of said hydraulic cylinders manufactured with dimensions in accordance with certain standards, without involving a weakening of said housings or end covers.

Such small electric position indicators transmit a magnetic field of a narrow extent, and by closing the through opening by means of the plate-shaped body according to the invention it is possible irrespective of the material of the housing or end covers of the cylinder to manufacture a body which is sufficiently thin, i.e. about 0.5 mm, to allow passage of such a small magnetic field through the body and into the interior of the cylinder. At the same time this body is sufficiently strong for withstanding the high operational pressures inside the cylinder.

As the piston of the hydraulic cylinder approaches the position indicator, said piston passes through the magnetic field transmitted by the position indicator, i.e. the piston enters the activation distance of the inductive sensor whereby the sensor transmits an altered signal indicating that the piston has now entered the position in question.

According to the invention the plate-shaped body may be made of a ceramic material, preferably steatite, which implies that the body can withstand very high limit values of the operational pressure.

Furthermore according to the invention the plate-shaped body may on the surface facing the interior of the cylinder comprise a surface coating so that the body is impervious to the hydraulic liquid.

According to a particularly advantageous embodiment of the hydraulic cylinder according to the invention, the plate-shaped body may be secured by means of glueing or is cast in.

Furthermore according to the invention the plate-shaped body may be circular, whereby it is particularly easy to manufacture. According to a particularly advantageous embodiment of the hydraulic cylinder according to the invention the plate-shaped body is situated in one of the end covers of the cylinder and preferably in a recess therein.

Moreover according to the invention at least one of the openings may be shaped as a cylindrical hole, whereby a particularly simple electric position indicator can be mounted in the opening.

In addition according to the invention at least one of the openings may be shaped as a conical hole narrowing towards the plate-shaped body, which implies that an electric position indicator can be mounted in the opening in a particularly simple manner.

Furthermore according to the invention at least one of the openings may be shaped as two coaxially extending holes of varying diameters. As a result, some electric position indicators can be mounted in the opening in a particularly accurate manner.

The hydraulic cylinder according to the invention may furthermore be provided with a compressing and/or throttle device being activated when the piston approaches the end cover, whereby the plate-shaped body and the position indicator are safeguarded, the piston being stopped before it touches the end cover. Furthermore the particular advantage is obtained that the length of the cylinder is not increased by this particular compressing and/or throttle device.

BRIEF DESCRIPTION OF THE DRAWING

The invention will be described below with reference to the accompanying drawing, in which.

DESCRIPTION OF THE PREFERRED EMBODIMENTS OF THE INVENTION

Figure 1:
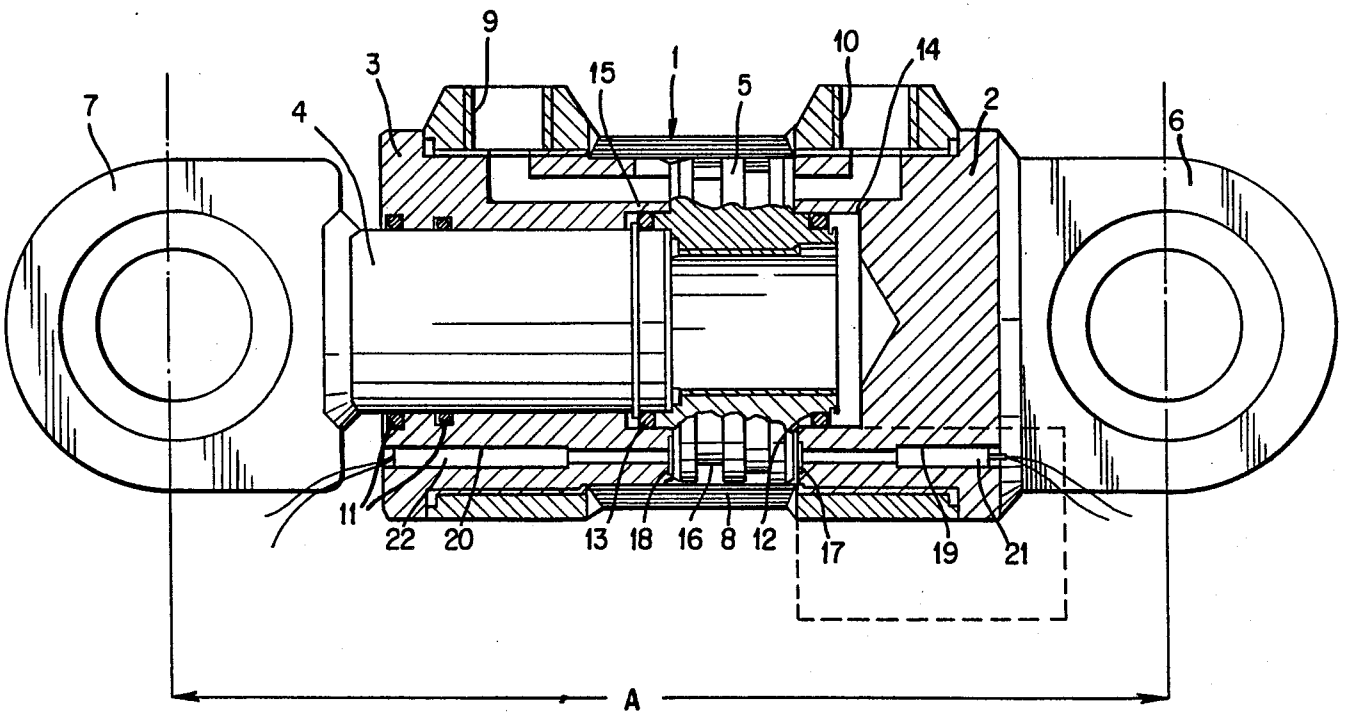
FIG. 1 is an axial sectional view of an embodiment of a hydraulic cylinder according to the invention with openings for the mounting of inductive sensors in each end cover of the cylinder and in a simplified compressed form with the stroke length zero.

The hydraulic cylinder 1 of FIG. 1 comprises as main members a first end cover 2, a second end cover 3 surrounding a piston rod 4, a piston 5 fixedly mounted on the piston rod, and a cylinder tube 8. Securing means 6 and 7 are provided at the end of the piston rod 4 and on the end cover 2 for the outward securing of the cylinder 1 and the piston rod 4, respectively. The hydraulic cylinder 1 is furthermore provided with in- and outlet gates 9, 10 for hydraulic oil. The piston 5 comprises one or more recesses 16 receiving rubber rings. In each end cover 2, 3 the embodiment of the hydraulic cylinder according to the invention shown in FIG. 1 comprises an opening 19 and 20, respectively, for the mounting of an inductive sensor 21 and 22, respectively. This embodiment turned out to be very suitable in practice because it is often of importance that it is possible to determine the end positions of the piston 5, i.e. when the piston 5 is positioned adjacent one end cover 2 or the other end cover 3, respectively. The openings 19, 20 extend from the outer end of the end covers 2, 3 and towards the interior of the cylinder where they are closed in a pressure- and liquid-proof manner by means of plate-shaped bodies 17 and 18, respectively. The plate-shaped bodies 17 and 18 are secured on the inner surface of the end covers 2, 3 and have in the embodiment shown been lowered into said surface. The openings 19 and 20 of this embodiment are shaped as two holes extending coaxially in extension of one another, which turned out to be an advantageous measure when using certain types of inductive sensors. As the invention relates in particular to relatively small hydraulic cylinders of diameters of between 25 and 125 mm, it has been possible when using especially narrow seal rings 11 and particularly narrow inductive sensors of a diameter of about 4 mm to situate the openings 19 and 20 in the narrow sides of the end covers 2, 3 without weakening the strength of said end covers 2, 3 to a substantial degree. With respect to the manufacture it is particularly advantageous to manufacture the plate-shaped bodies as circulate plates 17 and 18. When using the narrow inductive sensors, the area of the magnetic field transmitted by these sensors limits the thickness of the plates to less than about 0.5 mm. As the plates 17 and 18 must allow passage of a magnetic field it is a particular advantage when said plates are made of a ceramic material, preferably steatite, capable of withstanding limits in the operational pressure of up to about 1000 bar at a thickness of the plates of about 0.5 mm.

Figure 2:
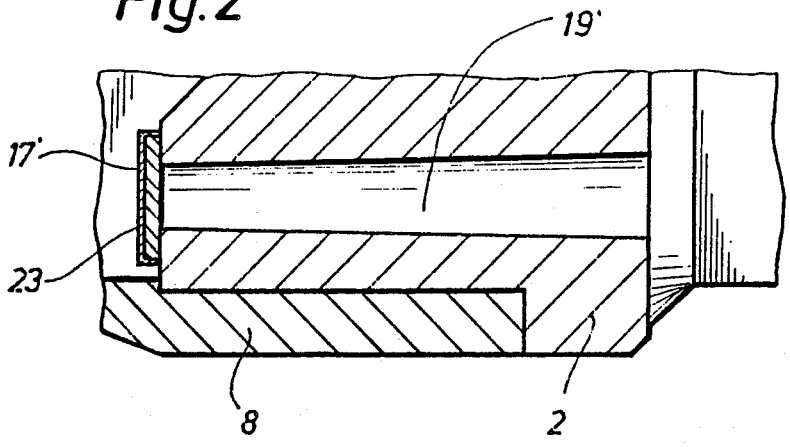
FIG. 2 illustrates on a larger scale part of a hydraulic cylinder with a differently shaped opening for the mounting of an inductive sensor corresponding to the area indicated by a dotted line in FIG. 1.

FIG. 2 illustrates a second embodiment of the opening 19', said opening being shaped as a conical hole in such a manner that other types of sensors can be received and secured therein. By this embodiment the plate 17' is situated on the outside of the inner surface of the end cover 2. The plate 17' may be provided with a coating 23 such as for instance a hard layer of lacquer in such a manner that the plate 17' is completely liquid-proof to the hydraulic oil.

Figure 3:
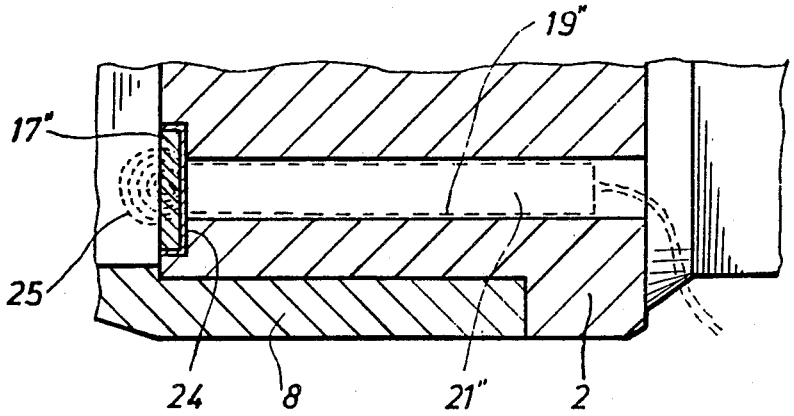
FIG. 3 illustrates like FIG. 2 on a larger scale part of a hydraulic cylinder with a third embodiment of the opening for the mounting of an inductive sensor indicated together with the magnetic field lines by a dotted line.

FIG. 3 illustrates a further embodiment of the opening 19'', said opening being shaped as a cylindrical hole allowing a very quick manufacture thereof. Furthermore it turned out to be particularly advantageous in practice to use a circular inductive sensor 21'' of a diameter of about 4 mm, cf. the dotted line. In this embodiment the plate 17'' is lowered into the inner surface of the end cover 2 and secured by means of a layer of glue 24, which turned out to be a very strong and reliable way of securing. The field lines of a magnetic field 25 have furthermore been diagrammatically shown by means of a dotted line, said lines spreading from the end of the inductive sensor 21'' through the plate 17'' and a distance into the interior of the cylinder 1. The thickness of the plate 17'' must be slightly smaller than the extension of this magnetic field which corresponds to the so-called activating distance of the inductive sensor 21'' in question. When the piston 5 enters and alters this magnetic field 25, an altered signal indicating the position is transmitted by the inductive sensor 21''. As the inductive sensors are relatively small, as mentioned of a diameter of about 4 mm, their activating distance usually being in the range of a few tenth mm is very short. Consequently, a very accurate determination of the position of the piston 5 is obtained compared to the known position-indicating systems of hydraulic cylinders. In practice within a limit less than 1/10 mm. It should furthermore be mentioned that the inductive sensor can be secured in the opening in many ways, e.g. by means of glueing, casting or squeezing.

FIG. 1 illustrates furthermore that the hydraulic cylinder 1 can be provided with seal rings 12 and 13, which implies that a closed chamber arises when the piston 5 approaches one or the other end cover 2 or 3, the oil being compressed in said chamber. The latter procedure occurs advantageously the last 2 or 3 mm before the piston reaches the end cover. In this manner an almost chock-like stopping of the piston 5 is obtained before it reaches one of the end covers 2 or 3, and the plate 17 or 18 and the inductive sensors 19 and 20 are thereby safeguarded against the influence of pressures or impacts exerted by the piston 5. When the piston 5 has been stopped, the compressed oil is throttled through a throttle hole 14 or 15 into the in- and outlet gate 9 or 10. FIG. 1 illustrates the A-measurement of the cylinder which corresponds to the distance between the securing means 6 and 7 of the cylinder, i.e. to the mounting measurement of a cylinder having a stroke length zero. If a hydraulic cylinder in a manner known per se is to be provided with a dampening- and piston-stopping device at each end cover, the A-measurement is increased by the length of the stopping device in question, which always must be considered when mounting the cylinder. When the hydraulic cylinder 1 according to the invention has been provided with the stopping means of FIG. 1, the A-measurement of the cylinder is not increased because these stopping means do not involve an increased length of the cylinder. With respect to the structure the latter is a great advantage because the length of the cylinder is thereby the same with or without stopping means mounted therein.

Finally it should be mentioned that the hydraulic cylinder according to the invention allows a mounting of electric position indicators for the position determination of pistons in all sizes of hydraulic cylinders, and another important feature that the latter can be done at an extremely low production price compared to previously. When mounting the small inductive sensors in particular hydraulic cylinders of diameters of between 25 and 125 mm, it is now furthermore possible to obtain a novel accurate and reliable position indication of the piston. The particular structure of the hydraulic cylinder according to the invention implies furthermore that said cylinder can withstand very high limit values in the operational pressure. A further great advantage is that the various shapes of the opening in the cylinder allow a mounting of electric position indicators of various shapes therein.

We claim:

1. A hydraulic cylinder comprising a piston completely or partially containing electrically conductive material, said cylinder being provided with at least one through opening for mounting an electric position indicator, characterized in that the openings are closed in a liquid- and pressure-proof manner toward the interior of the cylinder by means of a substantially plate-shaped body secured on the inner surface of the cylinder, said plate-shaped body allowing passage therethrough of a magnetic field, wherein at least one of the openings is shaped as a conical hole narrowing toward the plate-shaped body.

2. A hydraulic cylinder comprising: a piston at least partially containing electrically conductive material; at least one through opening in said cylinder for mounting an electric position indicator; and a substantially plate-shaped body secured on the inner surface of the cylinder for closing the at least one opening in a liquid- and pressure-proof manner towards the interior of the cylinder, said plate-shaped body being made of ceramic material to allow passage therethrough of a magnetic field.

3. A hydraulic cylinder as claimed in claim 2, wherein said ceramic material comprises steatite.

4. A hydraulic cylinder as claimed in claim 2, wherein the plate-shaped body is circular.

5. A hydraulic cylinder as claimed in claim 2, wherein the plate-shaped body is disposed in an end cover.

6. A hydraulic cylinder as claimed in claim 5, wherein said plate-shaped body is disposed in a recess in said end cover.

7. A hydraulic cylinder as claimed in claim 2, wherein at least one of the openings is shaped as a cylindrical hole.

8. A hydraulic cylinder as claimed in claim 2, wherein at least one of the openings is shaped as two coaxially extending holes of varying diameters.

9. A hydraulic cylinder comprising: a piston at least partially containing electrically conductive material; at least one through opening in said cylinder for mounting an electric position indicator; and a substantially plate-shaped body secured on the inner surface of the cylinder for closing the at least one opening in a liquid- and pressure-proof manner towards the interior of the cylinder, said plate-shaped body having a coating on a surface facing the interior of the cylinder, to allow passage therethrough of a magnetic field.

10. A hydraulic cylinder as claimed in claim 9, wherein the plate-shaped body is circular.

11. A hydraulic cylinder as claimed in claim 9, characterized in that the plate-shaped body is disposed in an end cover.

12. A hydraulic cylinder as claimed in claim 11, wherein said plate-shaped body is disposed in a recess in said end cover.

13. A hydraulic cylinder as claimed in claim 9, wherein at least one of the openings is shaped as a cylindrical hole.

14. A hydraulic cylinder as claimed in claim 9, wherein at least one of the openings is shaped as two coaxially extending holes of varying diameters.

15. A hydraulic cylinder comprising: a piston at least partially containing electrically conductive material; at least one through opening in said cylinder for mounting an electric position indicator; and a substantially plate-shaped body secured on the inner surface of the cylinder for closing the at least one opening in a liquid- and pressure-proof manner towards the interior of the cylinder, said plate-shaped body being secured by means of glueing or by casting to allow passage therethrough of a magnetic field.

16. A hydraulic cylinder as claimed in claim 15, wherein the plate-shaped body is circular.

17. A hydraulic cylinder as claimed in claim 15, wherein said plate-shaped body is disposed in an end cover.

18. A hydraulic cylinder as claimed in claim 17, wherein said plate-shaped body is disposed in a recess in said end cover.

19. A hydraulic cylinder as claimed in claim 15, wherein at least one of the openings is shaped as a cylindrical hole.

20. A hydraulic cylinder as claimed in claim 15, wherein at least one of the openings is shaped as two coaxially extending holes of varying diameters.

* * * * *